US006795975B2

(12) United States Patent
Marmaropoulos et al.

(10) Patent No.: US 6,795,975 B2
(45) Date of Patent: Sep. 28, 2004

(54) METHOD AND APPARATUS FOR SELECTIVE SHIELDING OF FABRIC ANTENNAS

(75) Inventors: George Marmaropoulos, Yorktown Heights, NY (US); Clive Read Van Heerden, Bronx, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 334 days.

(21) Appl. No.: 10/123,695

(22) Filed: Apr. 16, 2002

(65) Prior Publication Data

US 2003/0192102 A1 Oct. 16, 2003

(51) Int. Cl.[7] ..... A41D 31/00; H01Q 1/12; H01Q 1/36

(52) U.S. Cl. ..... 2/69; 2/905; 209/3.3; 343/718

(58) Field of Search ..... 2/69, 905; 343/718, 343/897, 700 MS; 455/100; 209/3.3; 342/357.01

(56) References Cited

U.S. PATENT DOCUMENTS 6,590,540 B1 * 7/2003 Adams et al. ..... 343/718
6,677,917 B2 * 1/2004 Van Heerden et al. ..... 343/897
6,680,707 B2 * 1/2004 Allen et al. ..... 343/718

* cited by examiner

*Primary Examiner*—Peter Nerbun
(74) *Attorney, Agent, or Firm*—Aaron Waxler

(57) ABSTRACT

A method and apparatus for selective shielding of fabric antennas incorporates the fabric antenna into the body of wearable garments and provides protection for wearers of the garment while allowing wearers to displace a portion of the garment body selectively, so as to render the antenna active or inactive. To protect wearers of the garment from the RF field that may be generated when an antenna is in use, a metallic fabric shielding layer is positioned in the body of the garment between the antenna and the body of a wearer. Another layer of metallic shielding fabric mounted to a layer of protective fabric formed as a displaceable layer of the garment body. The disclosed embodiments of the invention show displaceable layers in the form of foldable cuffs on sleeves, epaulets, decorative pocket-like flaps, and faux seams. Any of these displaceable layers may be retained in either "active" or "inactive" position, or both, by known retention devices, including snap fasteners, zippers, buttons, and hook-and-loop fasteners. In one embodiment, inherent tension in the structure of the garment is relied upon to maintain the shielding layer in the "active" position with the fabric antenna surface exposed, while the tension of the garment structure is overcome by a partially separable zipper device, to retain the shielding layer in its "inactive antenna" position.

18 Claims, 5 Drawing Sheets

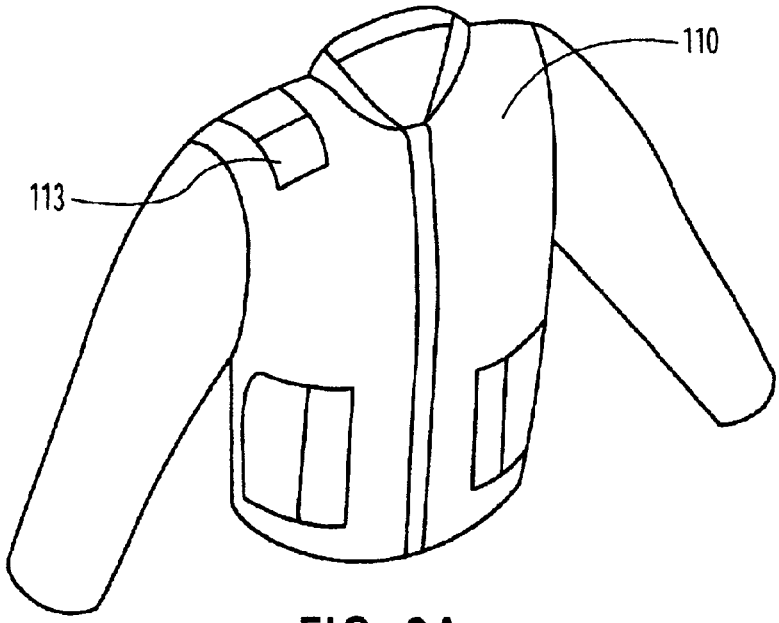
FIG. 2A
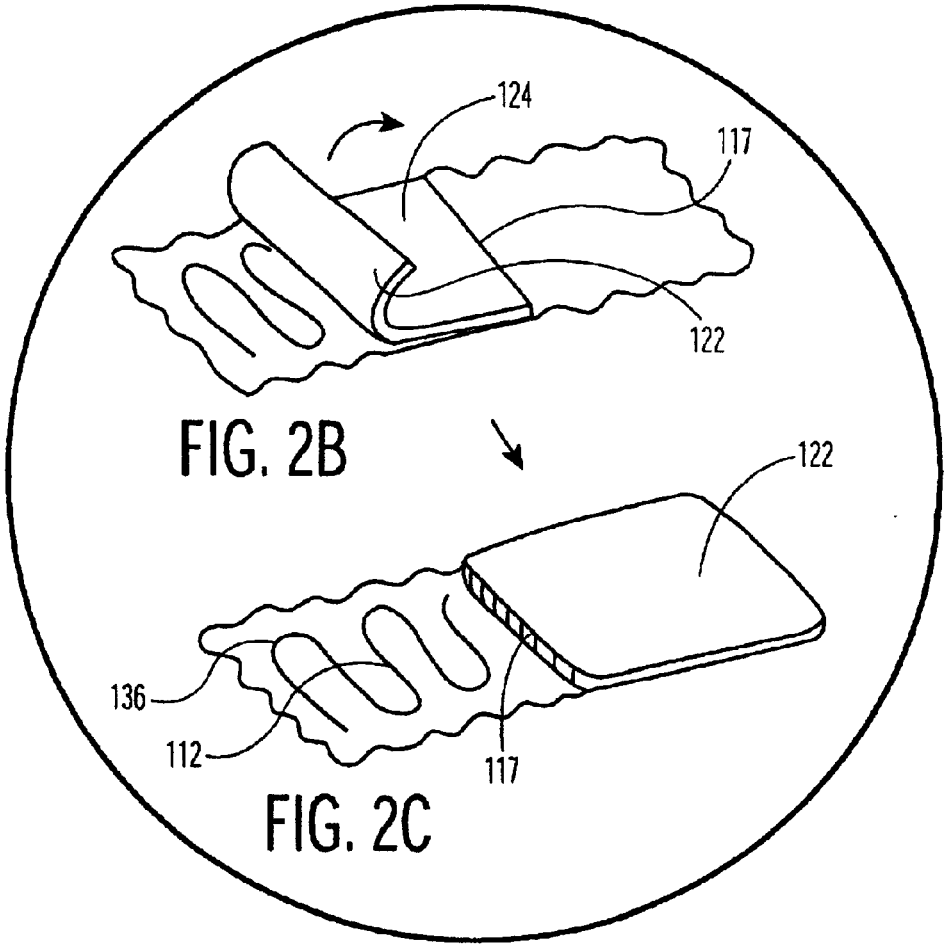

METHOD AND APPARATUS FOR SELECTIVE SHIELDING OF FABRIC ANTENNAS

FIELD OF THE INVENTION

This invention relates generally to fabric antennas, and, more specifically, to selective shielding of such antennas for the purpose of rendering them inoperative when necessary or desired.

DESCRIPTION OF THE RELATED ART

Electronic signal antennas incorporated into fabric and used for transmission and reception of radio frequency signals, have been known and used for some time. Such antennas have been incorporated into articles of clothing, both for marking (tracking) the clothing article, as in retail sales protection, as well as for monitoring internal and external conditions in the vicinity of, or directly affecting, the wearer of the clothing article.

However, it has been noted that existing, prior art antennas of this type, and particularly "tag" antennas associated with articles of clothing, have not generally allowed the wearers to choose or control the active or inactive state of the antenna, and have not afforded protection from RF signals for wearers of such articles of clothing. In this regard, it may be desirable in certain applications, to protect sensitive wearers from unnecessary exposure to RF signals, and in the same or other applications it may be desirable to render the antenna inactive so as to avoid unintended transmission or reception of signals that may lead to accidents or misunderstandings. Certain antennas, and particularly "tag" antennas, do not incorporate "on-off" switches for reasons attributable to their inherent design requirements, but nevertheless such antennas are often found in situations in which control of the antenna is desirable.

Accordingly, this invention provides methods and apparatus for rendering clothing-borne RF antennas selectively active or inactive. Further, this invention provides protection for wearers of clothing-borne RF antennas from unnecessary exposure to RF signals.

SUMMARY OF THE INVENTION

In the disclosed embodiments of this invention, fabric antennas are incorporated into articles of clothing such as coats, jackets and shirts, for example, in association with adjacent layers of different fabrics that provide electric field shielding with one type of fabric and RF shielding with another type of fabric. Both types of fabric are integrated directly into the structure of a wearable garment.

A first layer of shielding fabric is incorporated into the garment in a position lying between the antenna layer and the body of the wearer so as to protect the wearer from exposure to the RF field of the antenna.

This layer of shielding fabric in general can be made a structural part of the garment, immovable relative to the remainder of the garment, because it is not often necessary or desired to expose the human body to the RF signal field of an antenna carried by a garment other than one that is specifically intended for medical use.

A second layer of shielding fabric is positioned on a garment between the antenna and the outside environment in such a way that it can be displaced selectively, either to cover the antenna so as to shield it from signal transmission and/or reception, or to expose the antenna for normal use.

A feature of the invention is the incorporation of the displaceable layer of fabric into a portion of the garment that serves an ornamental or functional purpose independently of its shielding function.

Another feature of the invention is the provision of retention means for holding the displaceable fabric element in a position corresponding to either or both the active and the inactive conditions of the related antenna.

In accordance with at least one disclosed embodiment of the invention, the shielding layer of fabric reposes naturally in the "active antenna" position until it is moved to, and retained affirmatively in, its "inactive" position.

These and other features and advantages of this invention will be made more apparent to those having skill in this art, by reference to the following specification considered in conjunction with the accompanying drawings, in which:

BRIEF DESCRIPTION OF THE DRAWINGS

FIGS. 2A, 2B AND 2C are simplified pictorial representations of another embodiment of a shirt-like garment incorporating a displaceable shielding layer in accordance with this invention;

DETAILED DESCRIPTION OF THE PREFERRED EMBODIMENT

In the following description, certain specific details of the disclosed embodiments such as construction, minor functional elements, and techniques, etc, may be well-known in the existing art and are set forth herein for purposes of explanation rather than limitation, so as to provide a clear and thorough understanding of the present invention. It will be understood readily by those skilled in this art, that the present invention may be practiced in other embodiments which do not conform exactly to the details set forth herein, without departing significantly from the spirit and scope of this disclosure. Further, in this context, and for the purposes of brevity and clarity, detailed descriptions of well-known apparatus, mechanical elements and methodology have been omitted so as to avoid unnecessary detail and possible confusion.

Figure 5:
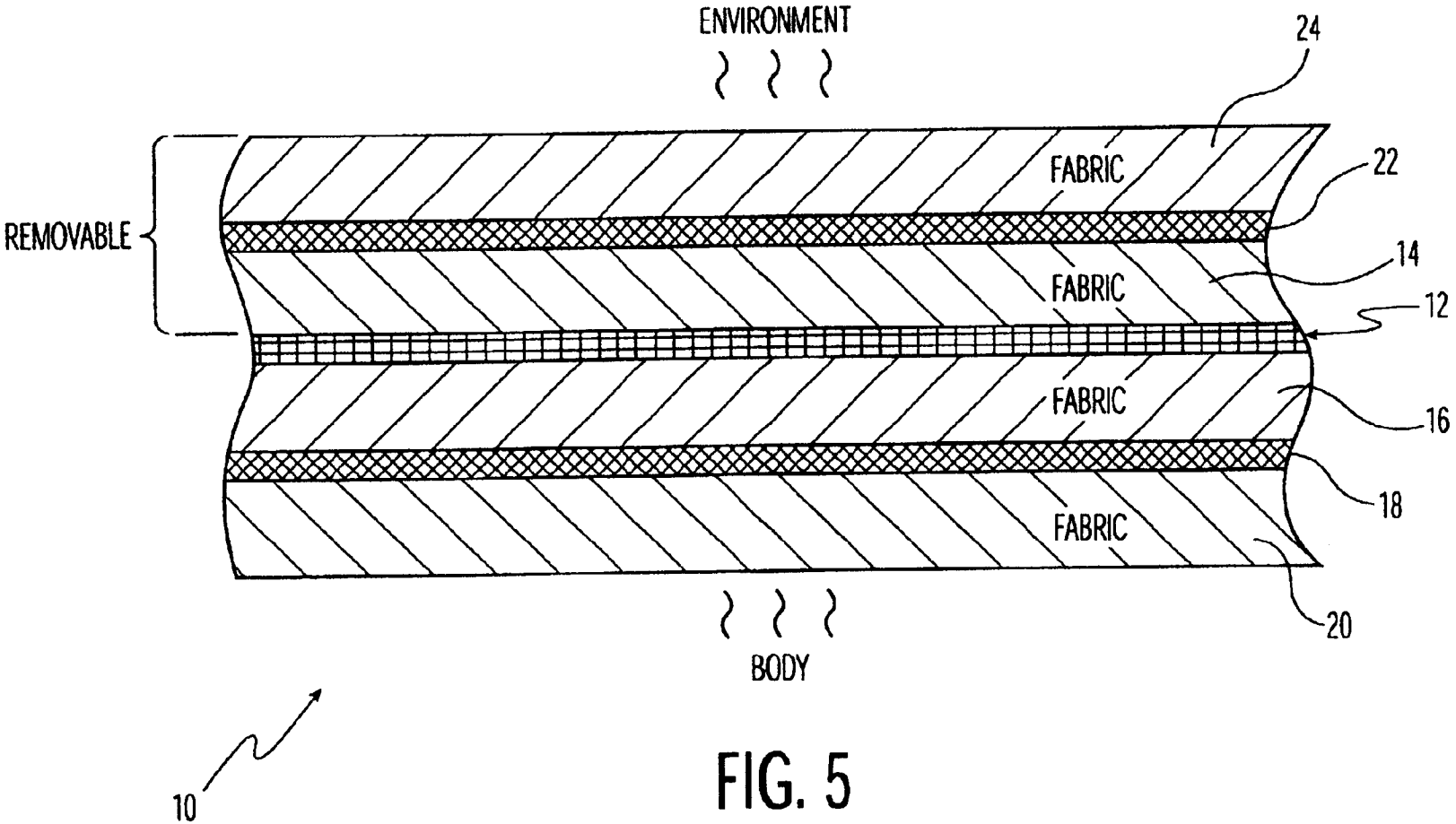
FIG. 5 is a cross-section view of a representative portion of the body of a garment constructed in accordance with this invention.

Referring now to FIG. 5 of the drawings, the illustrative body 10 of a garment constructed in accordance with this invention may be seen to comprise a fabric antenna layer 12 supported and protected typically by a separate fabric layer 16. Separate supporting layer 16 generally will be interposed between the antenna layer 12 and the body of the wearer, but it will be apparent that other arrangements can be made. On the side of support fabric layer 16 remote from antenna layer 12, a body-protecting RF shield layer 18, substantially coextensive in area with the fabric antenna layer 12, is supported on another supportive/protective fabric backing layer 20. When incorporated into any embodiment of a garment in accordance with this invention, layer 18 is always interposed between the area of antenna layer 12 and the body of a wearer of the garment so as to protect the wearer's underlying body surface from the electrical fields and/or electromagnetic RF signal fields resulting from operation of the garment-borne antenna. An antenna active/inactive shield layer 22, supported by a backing fabric layer 24, is positioned on the side of antenna 12 opposite to body shield layer 18. Active/inactive shield layer 22 is further covered and protected by an added protective layer 14 to avoid direct metallic contact between antenna layer 12 and shield layer 22. Preferably, protective layer 14 is mounted directly to the face of shield layer 22, so as to allow unimpeded operation of the exposed surface of antenna layer 12.

It will be made apparent in the remainder of this disclosure in connection with the illustrated garment embodiments, that in most garments, layers 12, 14, 16, 18 and 20 of body 10 will be fixed in relation to each other and to the body structure of the related garment; in turn, RF shield layer 22 and its protective backing fabric layers 14, 24 usually will be integrally associated with each other, but will be displaceable together relative to the composite of layers 12, 16, 18 and 20. The reasons for, and importance of, this structure will be disclosed in the following.

Figure 1:
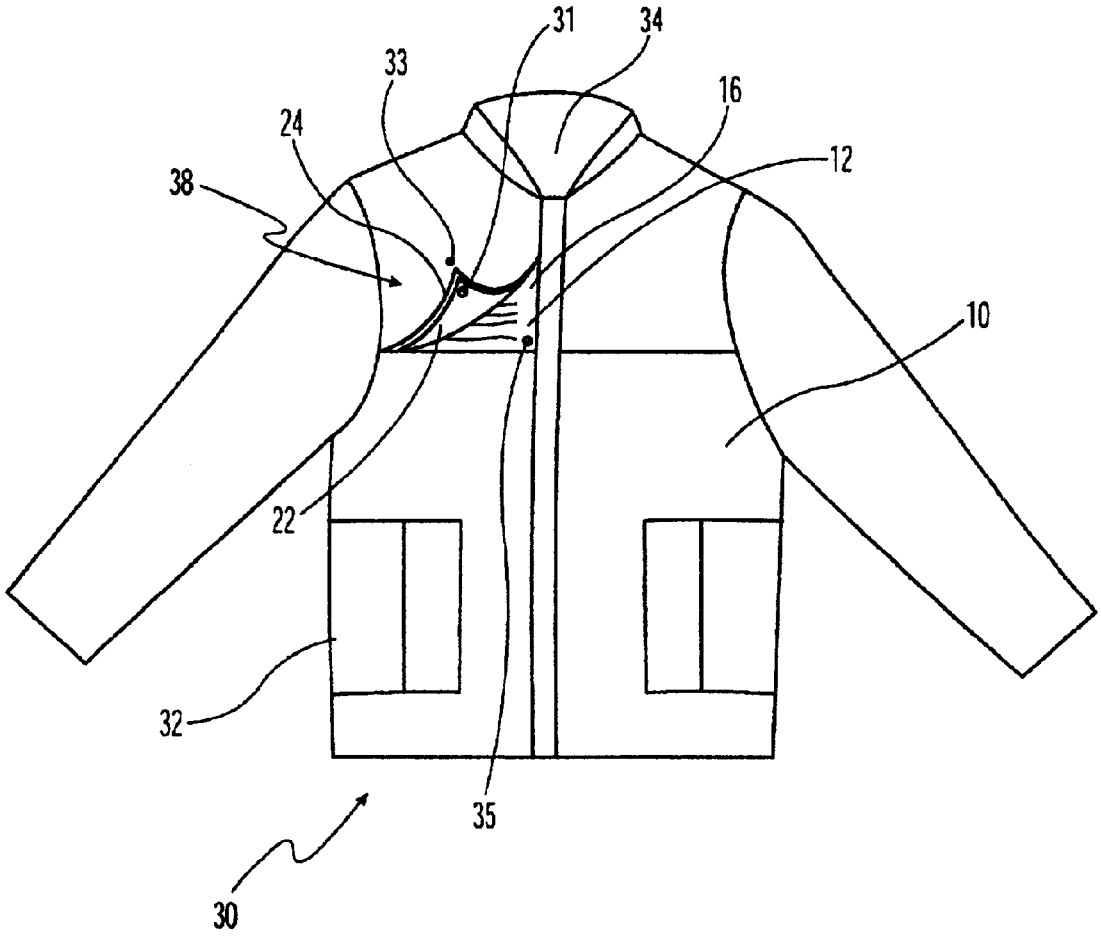
FIG. 1 is a simplified pictorial representation of a shirt-like garment incorporating a displaceable shielding layer in accordance with one embodiment of this invention.

Referring now to FIG. 1 of the drawings, a shirt-like garment 30 having a body 10 may be seen to comprise an antenna layer 12 mounted to fabric layer 16 of body 10. Garment 30 is characterized, as all garments are, by an exterior side 32 and an interior side 34. Antenna 12 has a given effective surface area 36 that defines the surface portion of the antenna that operates as an RF antenna. It will be apparent to those skilled in the antenna art that the effective area 36 may be equal to or less than the total surface area of fabric antenna element 12, but it will be equally obvious that the effective surface area is what is of concern for the purposes of this invention.

In accordance with this invention, the composite of metallic fabric antenna shielding layer 22 and the attached fabric support sheets 14, 24, are displaceable at least in part, between a first position [not shown] in which said given effective surface area of the fabric antenna element is overlaid by the shielding layer, and a second position 38, as shown in FIG. 1 of the drawings, in which at least part of the effective surface area of the fabric antenna element is exposed on the exterior side of the garment for active use as an antenna. As shown in FIG. 1, snap fastener parts 31,33,35 are mounted to fabric sheet 24 and to body 10 of garment 34 to hold shielding layer 22 in a desired position relative to surface 36 of antenna 12. In FIG. 1, sheet 24 is shown substantially midway between first and second positions. A fastener element 31 is affixed to a corner of sheet 24 so that the sheet may be engaged with either of two mating fastener halves 33 and 35. The inherent flexibility of sheets 14, 24 and shield layer 22 permits them to be displaced between the first, "antenna active" position where snap fastener 31 is engaged with mating fastener half 33, exposing antenna surface 36 on the exterior side of garment 30. In the second position of sheet 24, the "antenna inactive" position, fastener half 31 is engaged with mating fastener half 35, which is positioned to retain the corner of sheet 24 in the "antenna inactive" position, where antenna surface 36 is entirely overlaid by shielding layer 22 and fabric backing sheet 24. In this manner, using snap fasteners or any suitable known separable fastening device, sheet 24 with shield 22 may be moved and retained, selectively, in either an "antenna active" or "antenna inactive" position without otherwise affecting the structure or use of the garment 30.

In the garment embodiment illustrated in FIG. 2A, antenna element 112, seen most clearly in FIGS. 2B and 2C, is mounted to the exterior surface of garment body 110 and is selectively shielded by a displaceable shielding layer 122 mounted to a fabric backing layer 124. In this embodiment of the invention, shield 122 and backing sheet 124 together define a form of epaulet 113 located on the shoulder of garment 30. As illustrated in each of FIGS. 2A, 2B and 2C, epaulet 113 is configured for convenience and pleasing appearance, so that effective antenna surface area 136 comprises substantially ½ of the area defined by epaulet 113. Sheet 124 is coupled to body 110 by an integral fabric hinge joint 117. In this way when sheet 124 and shield 122 and any protective cover sheet over the shield surface are folded at hinge 117 to move them from the "antenna inactive" position shown in FIG. 2A, to the "antenna active" position represented in FIG. 2C, they will be displaced from overlying the entire area of the antenna on a first half of the epaulet to overlying only the remaining second half of the epaulet. In this manner, convenience, function and appearance are again joined in a pleasing and functional way to provide for selectively shielding antenna 112. It will be recognized readily that flap-like sheet 124 may be retained, as desired, in either the "active" or "inactive" position by any suitable and convenient fastening/retention means, including but not limited to buttons, snaps, ties, and hook and loop fasteners such as Velcro.

Figure 3A:
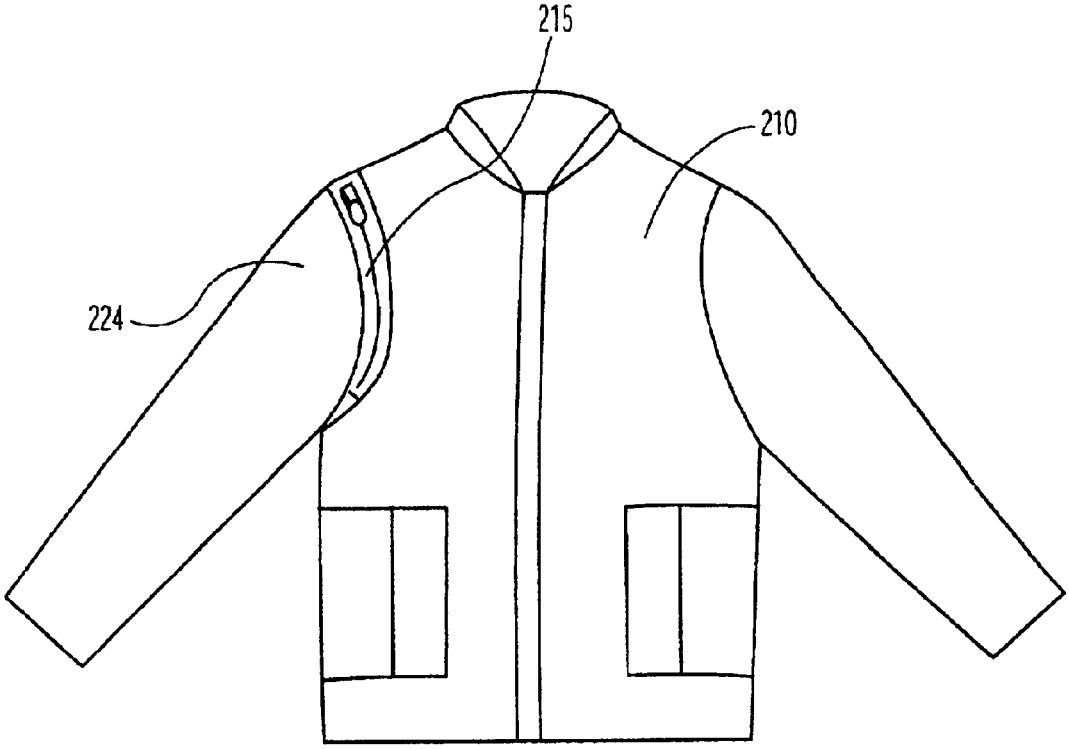
FIGS. 3A and 3B are simplified pictorial representations showing still another embodiment of a shirt-like garment incorporating a selectively displaceable shielding layer for an integral antenna in accordance with this invention.
Figure 3B:
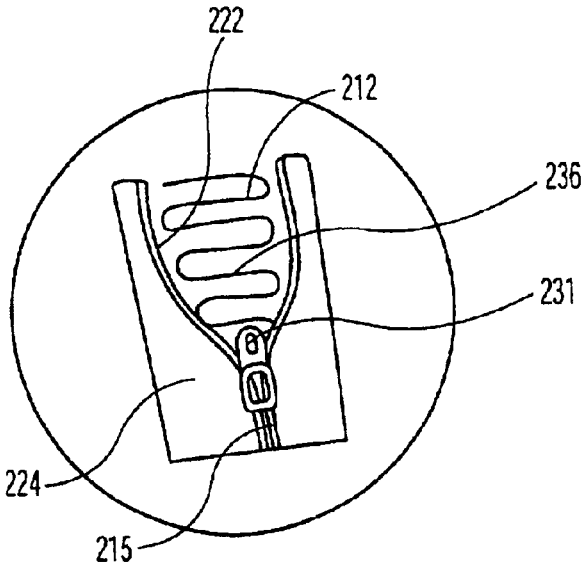

In the embodiment of FIGS. 3A and 3B, an antenna element 212 is mounted to the body 210 of garment 230 behind a faux seam 215 that is made to coincide with the juncture of the sleeve and the front of garment 230. Those having skill in the related art will recognize that such faux garment joints are known in the art where they have been used in the past for ornamental and decorative purposes. For the purposes of this invention, garment body 210 is fitted with an additional fabric layer 224 on one or both sides of seam 215, and with a zipper fastener 231 positioned coincident with the line of the seam so that the seam can either be opened to the "antenna active" position, or closed to the "antenna inactive" position. In this regard, it can now be recognized that fabric layer 224 is fitted with an underlying shielding layer 222, not seen in the drawings, to render antenna surface 236 of antenna 212, inactive when zipper fastener 231 is closed to draw fabric layer 224 into overlying relationship with the antenna surface. When zipper 231 is opened the inherent fabric tension in the garment can be relied on to move fabric 224 into its open position exposing antenna surface 236, as will be known to those having skill in the art of garment fabrication.

Figure 4A:
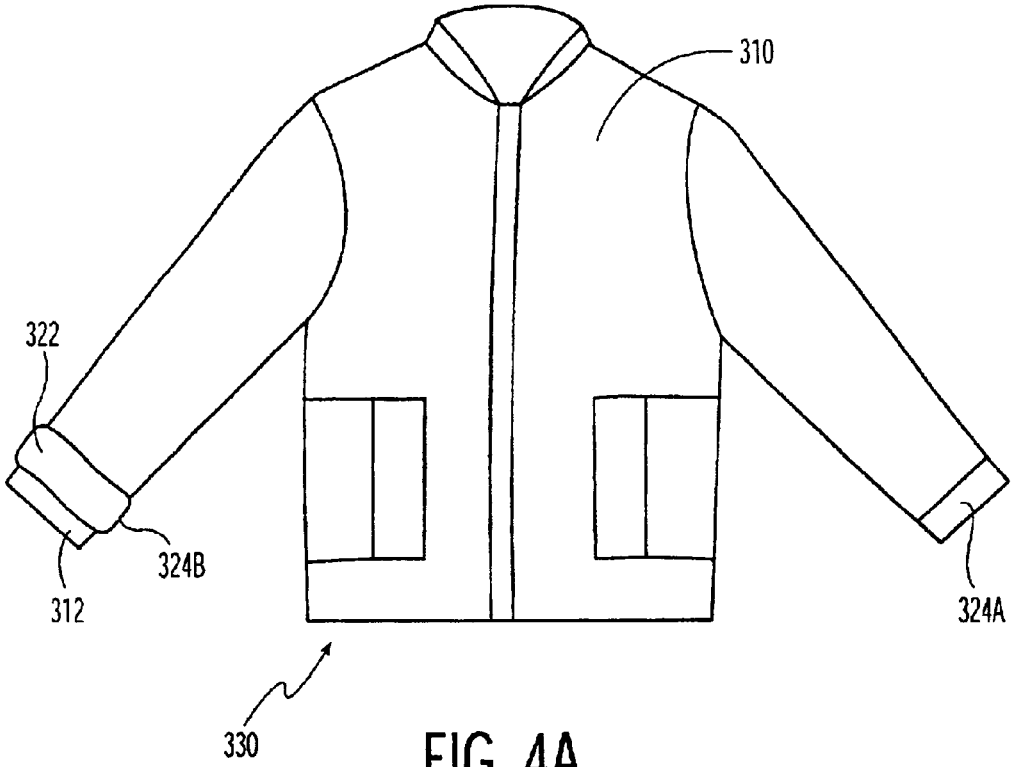
FIGS. 4A, 4B and 4C are simplified pictorial representations showing another and further embodiment of a shirt-like garment having an antenna and a displaceable shielding layer therefore incorporated into a sleeve of the garment.
Figure 4B:
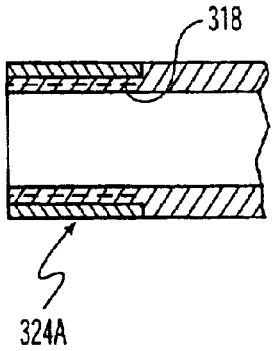
Figure 4C:
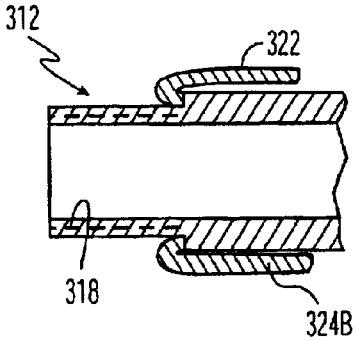

And now, with reference to the embodiment of the invention illustrated in FIGS. 4A, 4B and 4C, it can be seen that a shirt-like garment 330 is provided with an antenna element 312 mounted to the body 310 of the garment in the manner of a cuff at the free end of a sleeve. A displaceable concentric outer cuff 324 on the exterior side of antenna 312, is affixed to the sleeve of body 310 at one end of the cuff, and bears an inner shield layer 222. In use, cuff 324 is displaced by inverting it (turning it "inside out") from the extended or "antenna inactive" position shown at 324A in FIGS. 4A and 4B, to the rolled-back or "antenna active" position shown at 324B in FIGS. 4A and 4C.

Accordingly, in each of the embodiments of the invention herein disclosed, a garment-borne fabric antenna has been shown to be selectively shieldable by simple manipulation of associated parts of the garment that are both pleasing in appearance as well as functional. In accordance with the initial comments concerning the structure illustrated in FIG. 5, it will be understood that a body protecting RF shielding layer 18 may be incorporated into any of the embodiments of a garment constructed in accordance with this invention, in any manner suitable and appropriate to the nature of the disclosed embodiment and any modifications thereof that will be made apparent by these disclosures to those having ordinary skill.

Further with reference to the reference numerals used herein and in the accompanying claims, it should be recognized for clarity and completeness of understanding that the two-digit reference numerals and the corresponding three-unit reference numerals in the 200, 300 and 400 series are considered to be fully equivalent and they are to be regarded as interchangeable in the claims.

Although various preferred embodiments of the method and apparatus of this invention have been illustrated and described, those having skill in this art will recognize that various other forms and embodiments now may be envisioned readily without departing significantly from the spirit and scope of the invention disclosed herein and set forth in the accompanying claims.

What is claimed is:

1. A garment incorporating a selectively shieldable fabric antenna, comprising:

a fabric garment body structure defining a wearable garment characterized by an interior side and an exterior side;

a fabric antenna element overlying a portion of the surface area of said fabric body structure toward said exterior side thereof;

said fabric antenna element having a given effective surface area;

a metallic fabric antenna shielding layer positioned to overlie said fabric antenna element toward the exterior side of said fabric antenna element;

a fabric backing support layer attached to said metallic fabric antenna shielding layer on the exterior side thereof; and, said fabric backing support and said attached metallic fabric antenna shielding layer being displaceable at least in part, between a first position in which said given effective surface area of said fabric antenna element is entirely overlaid by said shielding layer and a second position in which at least part of said effective surface area of said fabric antenna is exposed on the said exterior side of said garment element for active use as an antenna.

2. A garment incorporating a selectively shieldable fabric antenna, in accordance with claim 1, wherein said fabric backing support and said attached metallic fabric antenna shielding layer are displaceable at least in part, between a first position in which said given effective surface area of said fabric antenna element is entirely overlaid by said shielding layer and a second position in which at least part of said effective surface area of said fabric antenna element is exposed on said exterior side of the garment for active use as an antenna.

3. A garment incorporating a selectively shieldable fabric antenna, in accordance with claim 2, further comprising separable fastener elements mounted to said garment body and said fabric backing support for separably fastening said fabric backing sheet and said associated shield layer selectively in said first position and said second position.

4. A garment incorporating a selectively shieldable fabric antenna, in accordance with claim 2, further comprising a protective fabric layer overlying said antenna shielding layer on the side thereof remote from said backing support, to separate said shielding layer form said antenna layer.

5. A garment incorporating a selectively shieldable fabric antenna, in accordance with claim 1, wherein said fabric backing support layer and said shielding layer are mounted to said garment body proximate the shoulder thereof in the form of an epaulet, having a portion of said support layer foldable about an integral hinge.

6. A garment incorporating a selectively shieldable fabric antenna, in accordance with claim 1, wherein:

said antenna element is located beneath a faux seam on the exterior side of said garment, at the juncture of a sleeve and the front of said garment; and, said garment further comprises a zipper fastener for opening and closing said seam to move backing support layer into and out of overlying relationship with said antenna.

7. A garment incorporating a selectively shieldable fabric antenna, in accordance with claim 1, wherein:

said antenna element mounted to said garment body in the manner of a cuff at the free end of a sleeve;

said fabric backing support layer comprises a displaceable concentric outer cuff shape on the exterior side of antenna;

said support layer being affixed to said sleeve of said body at one end of said cuff shape, and being displaceable by inversion, into and out of overlying relationship with said antenna element; and, said metallic fabric antenna shielding layer being affixed to the inner surface of said cuff shape to lie in opposed, overlying relationship with said antenna element when said cuff shape is in overlying relationship with said antenna element.

8. A garment incorporating a selectively shieldable fabric antenna, in accordance with claim 1, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

9. A garment incorporating a selectively shieldable fabric antenna, in accordance with claim 2, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

10. A garment incorporating a selectively shieldable fabric antenna, in accordance with claim 3, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

11. A garment incorporating a selectively shieldable fabric antenna, in accordance with claim 4, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

12. A garment incorporating a selectively shieldable fabric antenna, in accordance with claim 5, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

13. A garment incorporating a selectively shieldable fabric antenna, in accordance with claim 6, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

14. A garment incorporating a selectively shieldable fabric antenna, in accordance with claim 7, further comprising:

a wearer's body-protecting RF shield layer substantially co-extensive with said fabric antenna element; and, said body-protecting RF shield layer being positioned on said garment body so as to be interposed between said antenna element and the underlying body of a wearer of said garment.

15. A selectively shieldable tag antenna system for garments, comprising:

a wearable garment having a body member characterized by an inner side and an outer side;

a fabric antenna of given surface area incorporated into said body member; and, a displaceable antenna-shielding layer movably coupled to said body member for selective displacement between a first position in which said antenna shielding layer overlies said given surface area of said antenna and a second position in which said antenna surface area is substantially exposed to the outer side of said body member.

16. A garment incorporating a selectively shieldable fabric antenna, in accordance with claim 15, wherein said displaceable shielding layer further includes a first protective layer interposed between said antenna and said shielding layer when said shielding layer is disposed in said first position.

17. A method for controlling the electromagnetic fields associated with an antenna mounted on a garment having an inner side and an outer side, said method comprising the steps of:

positioning an electromagnetic shielding layer in overlying relationship with the outer side of said antenna;

attaching said shielding layer to said garment so that it is displaceable relative to said garment;

displacing said shielding layer from overlying relationship with said antenna to permit said antenna to transmit and receive electromagnetic radiation; and, returning said shielding layer to overlying relationship with said antenna to render said antenna inactive.

18. The method of claim 17 further comprising the steps of:

interposing a protective layer positioned between said antenna and said shielding layer when said shielding layer is positioned in overlying relationship with said antenna; and, attaching said protective layer to said shielding layer.

* * * * *